United States Patent [19]

Stoeger et al.

[11] 4,360,409

[45] Nov. 23, 1982

[54] APPARATUS FOR THE GALVANIC DEPOSITION OF ALUMINUM

[75] Inventors: Klaus Stoeger, Nuremberg; Siegfried Birkle, Hoechstadt; Johann Gehring, Spardorf, all of Fed. Rep. of Germany

[73] Assignee: Siemens Aktiengesellschaft, Berlin & Munich, Fed. Rep. of Germany

[21] Appl. No.: 269,490

[22] Filed: Jun. 2, 1981

[30] Foreign Application Priority Data

Jun. 20, 1980 [DE] Fed. Rep. of Germany ..... 3023129

[51] Int. Cl.[3] ..... C25D 5/00; C25D 17/18

[52] U.S. Cl. ..... 204/14 N; 204/213; 204/275; 204/277

[58] Field of Search ..... 204/213, 275, 277, 14 N

[56] References Cited

U.S. PATENT DOCUMENTS 3,425,926 2/1969 Hojyo ..... 204/213

4,066,515 1/1978 Stoger ..... 204/213

*Primary Examiner*—T. Tufariello

*Attorney, Agent, or Firm*—Hill, Van Santen, Steadman, Chiara & Simpson

[57] ABSTRACT

A system for the galvanic deposition of aluminum from aprotic organo-aluminum electrolytes free from oxygen and water wherein it is not necessary to remove a galvanizing drum from its associated galvanizing tank in order to load and unload work pieces being galvanized from the drum.

16 Claims, 2 Drawing Figures

APPARATUS FOR THE GALVANIC DEPOSITION OF ALUMINUM

BACKGROUND OF THE INVENTION

The present invention lies in the field of systems for the galvanic deposition of aluminum from aprotic organoaluminum electrolytes (which are free), water and oxygen onto work pieces being aluminized.

A device suitable for such deposition has become known through the German Patent 25 37 285. In such device, the galvanizing drum must be withdrawn from the galvanizing tank for loading and unloading purposes which is not only extremely complicated and time consuming, but also necessitates appropriately sized insertion and removal openings for the galvanizing drum. As is known, air must be excluded from the organoaluminum electrolyte which is produced under oxygen-free and water-free conditions as any contact with air will, as a result of a reaction with oxygen and atmospheric moisture, lead to a substantial reduction in the conductivity and thus in the life duration. For this reason, galvanization with electrolytes of this kind must be carried out with air excluded. In the known device, such exclusion can only be achieved by pumping the electrolyte back into its feed container under a shield or inert gas atmosphere following galvanization. Before the electrolyte is reintroduced into the galvanizing tank following the reloading of the galvanizing drum, the galvanizing tank must be flooded with inert liquid and then brought into an inert gas atmosphere. This is complicated and time consuming.

BRIEF SUMMARY OF THE INVENTION

The present invention more particularly is directed to a device for the galvanic deposition of aluminum onto work pieces from aprotic, organo-aluminum electrolytes which are free of oxygen and water using a heatable galvanizing tank which can be closed so as to be air-tight and which can be supplied with an inert gas. A rotatable galvanizing drum is arranged inside the galvanizing tank, and a feed container for the electrolyte is connected to the galvanizing tank. Two further containers serve to store inert liquids.

A principal aim of this invention is to provide a device in which it is no longer necessary to remove the galvanizing drum from the galvanizing tank in order to load and unload bulk goods being galvanized from the drum. This aim is realized in accordance with this invention in that the filling of the galvanizing drum is effected by means of a transport device for the bulk goods which are to be aluminized which device leads into the interior of the galvanizing tank via an airlock and which terminates above a sealable opening in the galvanizing drum. The opening and closure of the galvanizing drum can be effected from the exterior. The galvanizing drum can be emptied by means of a discharge container which can be supplied with inert gas and inert liquid and which is arranged beneath the galvanizing tank and is connected thereto via a lockable, tubular connecting component.

Other and further objects, purposes, advantages, aims, utilities, features and the like will be apparent to those skilled in the art from a reading of the present specification taken together with the drawings.

BRIEF DESCRIPTION OF THE DRAWINGS

The invention is explained in detail making reference to the drawings which illustrate two exemplary embodiments each in schematic fashion.

DETAILED DESCRIPTION OF THE PREFERRED EMBODIMENTS

Figure 1:
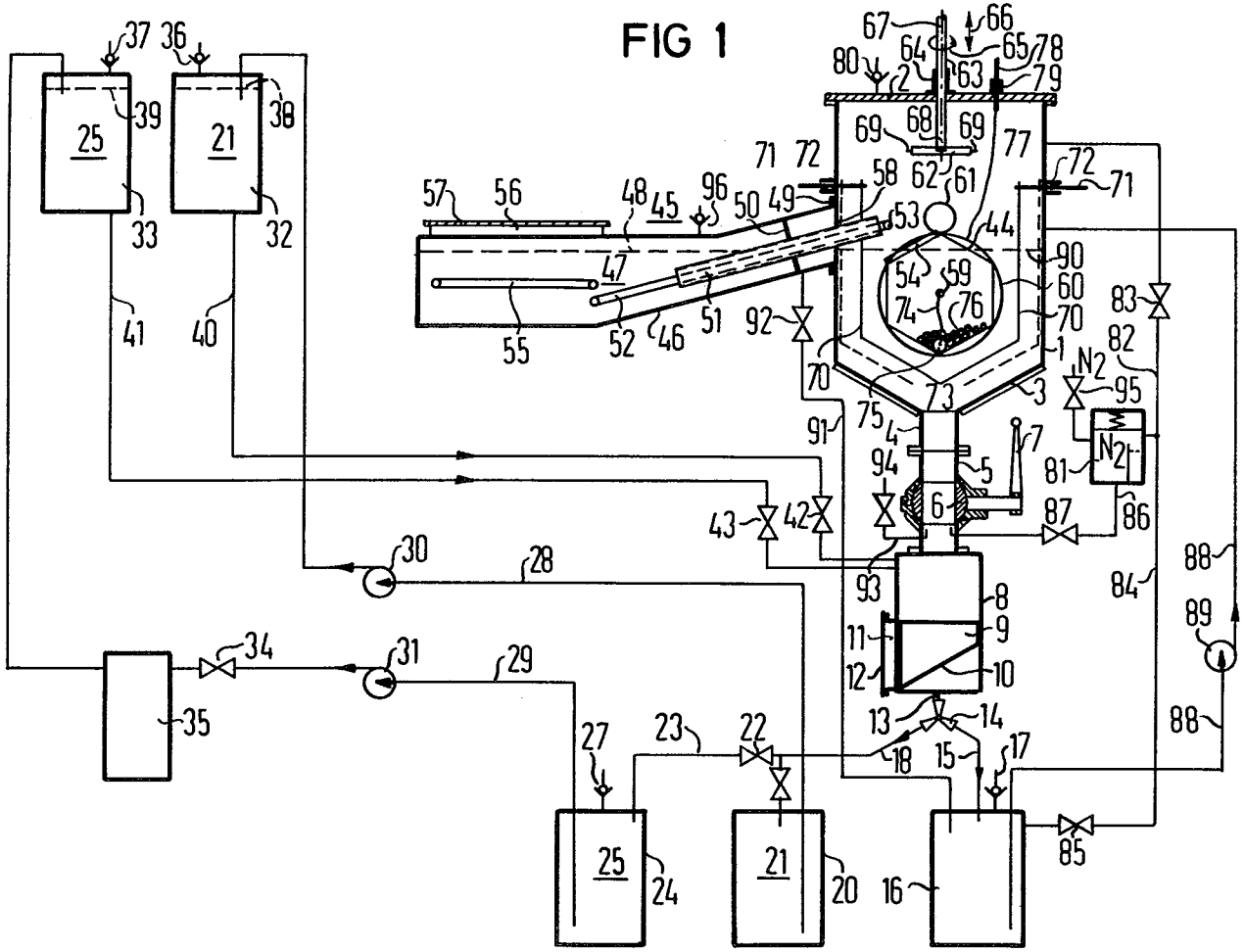
FIG. 1 schematically illustrates one embodiment of a device for the galvanic deposition of aluminum which has been partially simplified, and FIG. 2 fundamentally illustrates another embodiment of such a device but which incorporates two galvanizing drums.

The structure employed in the present invention has an advantage in that the galvanizing tank which is supplied with inert gas always contains electrolyte. In practice, only a tiny proportion thereof is discharged into the discharge container. Therefore, it is extremely advantageous for the volume of the discharge container flange attached to the connecting component to correspond approximately to that of the contents of the galvanizing drum. A simple construction consists in a tubular lockable connecting component that contains a commercially available ball valve.

The problem of loading the galvanizing drum can be solved in a simple fashion. The transport device which extends into the interior of the galvanizing tank leads through a channel which rises obliquely upwards. The end of the channel is located outside the galvanizing tank, and is submerged into a container, filled with an inert liquid suitable for airlock use. Here, the container which is filled with such inert liquid is tightly flange attached to the galvanizing tank, and the channel which accommodates the transport device rests in sealing fashion against the container of the liquid sluice by means of at least one partition wall.

The discharge container expediently contains a perforated basket which can be removed through a laterally arranged hatch that can be closed so as to be air-tight.

In accordance with a further feature of the invention, that part of the galvanizing drum which is submerged into the electrolyte is surrounded by two anodes which can be adjusted relative to one another in such a manner that they form a passage for the bulk goods which are to be emptied.

Advantageously, the inert gas feed container is connected through valved ducts to the galvanizing tank, to the discharge container, and to the electrolyte feed container. The appropriate valves are controlled in such a manner as to form a closed inert gas cycle.

In accordance with a further development of the invention, the galvanizing tank includes two galvanizing drums so that two loads can be moved simultaneously under in part non-identical conditions.

A galvanizing tank 1 is provided which is sealed in gas-tight fashion by a cover 2. The galvanizing tank 1 is provided with a heater unit 3 and possesses a discharge pipe 4 to which is flange attached a tubular connecting component 5 provided with a ball valve 6. Valve 6 can be actuated by means of a manual lever 7. The connecting component 5 is flange attached to a discharge container 8 which is fabricated as an unloading airlock and in which there is accommodated a perforated filling basket 9 having a sloping base 10. The filling basket 9 can be removed through hatch 11 which is arranged on the side of the discharge container 8 and which can be sealed in gas-tight fashion by means of a cover 12. A three-way valve 14 is attached to the base of the discharge container 8 through a pipeline 13 and is connected through a pipeline 15 to an electrolyte feed container 16 sealed in gas-tight fashion. The electrolyte feed container 16 is equipped with pressure relief valve 17.

The three-way valve 14 is connected through a pipeline 18 and through a valve 19 to a container 20 into which can be discharged an inert liquid 21 used for flooding or flushing the discharge container 8. The pipeline 18 is also connected through a valve 22 and a pipeline 23 to a further container 24 into which can be discharged an inert liquid 25 which is used for washing the bulk goods in the discharge container 8. The two containers 20 and 24 are provided with pressure relief valves 26 and 27. The container 20 and 24 are arranged beneath the three-way valve 14 so that the inert liquids 21 and 25 can reach this point by means of the force of gravity. By means of pumps 30 and 31, the inert liquids 21 and 25 can be pumped through pipelines 28 and 29 into feed container 32 and 33. A vaporizer 35 is connected into the pipeline 29 through a valve 34 and can be used to cleanse the inert liquid 25, used for washing purposes, of enriched electrolyte. The containers 32 and 33 are likewise equipped with pressure relief valves 36 and 37. The containers 32 and 33 are normally filled with inert liquids 21 and 25 as indicated by broken lines 38 and 39 which indicate the liquid level. The feed containers 32 and 33 are connected to the discharge container 8 via pipelines 40 and 41. Valves 42 and 43 which serve to control the inert liquids 21 and 25 are arranged in the pipelines 40 and 41.

A loading airlock 45 which is constructed as a liquid seal is provided for loading the galvanizing drum 44 arranged in the galvanizing tank. The loading airlock 45 consists of a container 46 which contains an inert liquid 47, the level 48 thereof therein being indicated by a broken line. The container 46 is attached in gas-tight fashion to the galvanizing tank 1 by means of a flange 49. In the container 46, a channel 51, which rises obliquely upwards, is attached by means of a diaphragm 50, and in this channel a transport device in the form of a conveyor belt 52 leads into the interior of the galvanizing tank 1. The end 53 of the transport belt 52 terminates above an opening 54 in the galvanizing drum 44. On the other side, the channel 51 is extended to such an extent that it is fully submerged into the inert liquid 47 so that the bulk goods which can be delivered by means of a further conveyor belt 55 reach the end of the conveyor belt 52 and from there are fed via the end 53 into the galvanizing drum 44. In the exemplary embodiment illustrated in FIG. 1, the conveyor belt 55 is fully submerged into the inert liquid 47. However, it can also be submerged obliquely from above into the inert liquid 47 so that the bulk goods can be placed more easily onto the conveyor belt 55. The conveyor belt 55 is loaded through an opening 56 in the container 46 which can be closed by means of a hatch cover 57. The diaphragm 50 is arranged in gas-tight fashion between the container 46 and the channel 51 and supports the channel 51. In order to increase the stability, a plurality of diaphragms 50 can be provided. Therefore, that end of the channel 51 which extends into the interior of the galvanizing drum 1 can be introduced slackly into the interior of the galvanizing drum 1 through an opening 58. This quite substantially simplifies assembly.

As can be seen from FIG. 1, the galvanizing drum 44 has a generally hexagonal cross-section. Here, the drum casing is perforated in known manner. The galvanizing drum 44 is rotatably mounted on shaft 59 in the tank 1. The galvanizing drum 44 is equipped with a gear rim 60 which engages with a gear wheel 61. The gear wheel 61 is driven by an electric motor (not shown). The opening 54 of the galvanizing drum 44 is closable by a cover 62. As the interior of the galvanizing drum 1 is sealed in gas-tight fashion, the cover 62 can be lifted by means of a lifting mechanism 63 which leads tightly through the cover 2 of the galvanizing tank 1 by means of guides 64. As indicated by the arrows 65 and 66, the lifting mechanism 63 can be moved both in the axial direction and about is axis of rotation 67. At the lower end 68 of the lifting mechanism is arranged an unlocking mechanism (not shown in detail) with the aid of which the unlocking pins 69 arranged on the cover 62 can be operated. These unlocking pins 69 form a shape-locking connection with corresponding bores at the edge of the opening 54 of the galvanizing drum 44.

The galvanizing drum 44 is surrounded by two anodes 70 arranged homologously, where the anode terminals 71 lead out of the galvanizing tank 1 through anode ducts 72. By moving the anode terminals 71, the anodes 70 can be adjusted towards the walls of the galvanizing tank 1 as indicated in broken lines. This exposes an opening 73 so that the contents of the galvanizing drum 44 can be emptied into the discharge container 8 through the discharge pipe 4.

The shaft 59 is attached through a cable 74 composed of conductive material to a club-shaped cathode 75 which can be actively connected to the bulk goods 76 contained in the galvanizing drum 44. The shaft 59 is connected via a further electrical cable 77 to a cathode terminal 78 which leads through an opening 79 through the cover 2 of the galvanizing tank 1. The cover 2 of the galvanizing tank also possesses a pressure relief valve 80.

Also provided is an inert gas container 81 which is connected through a pipeline 82 and a valve 83 to the galvanizing tank 1, and through a pipeline 84 and a valve 85 to the electrolyte feed container 16. The inert gas container 81 is connected to the connecting component 5 through a further pipeline 86 and a valve 87.

The electrolyte feed container 16 is connected via a pipeline 88 to the galvanizing tank 1 so that, when necessary, a pump 80 can be used to pump electrolyte into the galvanizing tank 1 to maintain therein a predetermined level 90 as indicated by the broken lines.

The area of the container 46 behind the diaphragm 50 is connected to the electrolyte feed container 16 via a pipeline 91 and a valve 92. The container 46 is also equipped with a pressure relief valve 96. Following the washing of the bulk goods 76 with inert liquid 25, the discharge container 8 can either be ventilated or subjected to inert gas via the valve 94 and a pipeline 93. A valve 95 in the inert gas feed container 81 is needed for the inert gas, such as $N_2$, requirement from a bottle.

The description of the mode of operation of the device has been based on the assumption that the galvanizing tank 1 contains an aluminum electrolyte, and the galvanizing drum 44 assumes a position in which the opening 54, closed by the cover 62, is located below the lifting mechanism 63. It has further been assumed that all the valves are closed and the feed containers 32 and 33 contain inert liquid for flushing and for washing. Furthermore, it is assumed that the container 46 contains inert liquid 47 for sealing the loading airlock 45. Thus, the system is ready for operation.

The following operating steps now take place for a galvanization process:

The galvanizing drum 44 is opened by lifting the cover 62 by means of the lifting mechanism 63. Thus, the lifting mechanism 63 is moved downwards in the direction of the arrow 66 towards the cover 62 which closes the opening 54 of the galvanizing drum 44.

As a result of the rotation of the lifting mechanism 63 is the direction of the arrow 65, the cover 62 is unlocked. Thus, the unlocking pins 69 are drawn out from the corresponding bores in the wall of the opening 54 of the galvanizing drum 44. Then, the lifting mechanism 63, with the cover 62 suspended therefrom, is brought into the starting position illustrated in FIG. 1.

The galvanizing drum 44 is next rotated by 30° to the left into a starting position as illustrated in FIG. 1. Then, the cover 57 of the loading sluice 45 is opened.

The valve 83 is opened to connect the galvanizing drum 1 to the inert gas feed container 81.

The galvanizing drum 44 is loaded with bulk goods 76 by means of the conveyor belts 55 and 52 which have been set in motion. The inert gas which has been displaced out of the galvanizing tank 1 by the volume of the supplied bulk goods 76 flows through the valve 83 into the inert gas feed container 81. The inert gas feed container 81 serves for pressure compensation in the event of volumetric changes in the galvanizing tank 1, in the connecting component 5, and in the discharge container 8 of the unloading airlock 45. As a result of this inert gas cycle, no inert gas is lost. Moreover, the processes which must be carried out, and which will be described in detail below, can always be effected with 100% inert gas. Any moisture and air which may be drawn into the inert gas feed container 81 is chemically eliminated by triethyl aluminum. When the galvanizing drum 44 has been loaded, the valve 83 is closed.

The galvanizing drum 44 is rotated by 30° in clockwise direction.

The galvanizing drum 44 is closed with the cover 62 by lowering the lifting mechanism 63 and then rotating in the opposite direction as shown by the direction of the arrow 65 whereby the unlocking pinds 69 engage in shape-locking fashion into the assigned bores in the walls of the opening 54 of the galvanizing drum 44.

The drum drive is switched on so that the galvanizing drum 44 is rotated by the gear wheel 61 and the gear rim 60 at an appropriate speed for the galvanization, and connection of the galvanization voltage to the cathode terminal 78 and to the anode terminals 71 is accomplished.

At the end of the galvanization process, the galvanizing current is disconnected, the anodes 70 are brought into the broken line position so that the opening 73 is formed, and the cover 62 of the galvanizing drum 44 is raised by the lifting mechanism 63 in the above described manner.

Before the galvanizing drum 44 is unloaded, the following processes are first carried out: By opening the valve 42, the discharge container 8 has been filled with inert liquid 21 and the air contained in the discharge container 8 has escaped via the open valve 94. Then, these respective valves are closed, and the valve 87 is opened to the inert gas feed container 81. Furthermore, the valve 19 is opened to the container 20, and the three-way valve 14 is adjusted in such manner that the flushing liquid can discharge from the discharge container 8 through the pipeline 18 into the container 20. Inert gas also flows from the inert gas feed container 81 into the discharge container 8 through the pipeline 86.

The air in the container 20 is thus able to escape through the pressure relief valve 26. The end of the flooding process can consist, for example, of a level regulation, which has not been described in detail, however, but which may be conventional. Then, the valves 19 and 87 and the three-way valve 14 are closed. Thus, the container 8 contains only inert gas from the inert gas feed container 81. By means of the manual lever 7, the ball valve 6 is now opened so that electrolyte flows out of the galvanizing tank 1 through the connecting component 5 into the discharge container 8 and the displaced inert gas flows into the galvanizing tank 1. To compensate for the pressure, the valve 83 is opened. Now the drum is rotated by 180° into its emptying position so that the bulk goods 76 fall through the connecting component 5 into the filling basket 10 of the feed container 8. Electrolyte is now displaced out of the feed container 8 into the galvanizing tank 1 so that the discharge container 8 contains only very little electrolyte. By appropriate dimensioning of the volume of the discharge container 8, the remaining quantity of electrolyte can be limited to a minimum.

Then, the ball valve 6 is closed.

The three-way valve 14 is now adjusted in such a manner as to establish a connection from the discharge container 8 to the electrolyte feed container 16 and in fact via the pipelines 13 and 15. In order to compensate for the pressure, the valves 85 and 87 are opened so that the inert gas of the electrolyte feed container 16, which is subject to an inert gas atmosphere, can escape via the valve 85 to the inert gas feed container 81, whereas the volume of the discharged electrolyte in the discharge container is replaced by inert gas via the valve 87. Here, it has been assumed that the electrolyte feed container 16 always contains a 100% inert gas atmosphere.

As soon as the discharge container 8 is fully emptied, the three-way valve 14 is closed.

The electrolyte contained in the electrolyte feed container 16 is pumped back into the galvanizing tank 1 by the pump 89 and via the pipeline 88, and the electrolyte volume is replaced by inert gas via the valve 85.

Then, the valve 85 is closed.

Now, the valve 43 is opened. As a result, the inert liquid 25 provided for washing purposes flows out of the feed container 33 via the pipeline 41 into the discharge container 8. Now, the inert atmosphere in the discharge container 8 can flow via the valve 87 and the pipeline 86 into the inert gas feed container 81.

The valve 43 is closed from the feed container 33. The three-way valve 14 is now set in such manner that the discharge container 8 can flow via pipelines 18 and 23 into the container 24 when the valve 22 is opened. The inert liquid 25 which is discharged from the discharge container 8 is replaced by air via the pipeline 93 when the valve 94 is opened.

The valve 22 and the three-way valve 14 are then closed. By removing the cover 12 the discharge container 8 can be opened and the filling basket 9 together with the washed bulk goods 76 can be removed. It should be noted that the washing process can be repeated as often as desired in the described manner.

The emptied filling basket 9 is returned to the discharge container 8 and the discharge container 9 is sealed in air-tight fashion when the cover 12 is placed in position. When the valve 94 is open, if the valve 42 is opened, the discharge container 8 is flooded with inert liquid 21 from the feed container 32, as a result of which the displaced air can escape via the valve 94. Then, the valve 94 is closed, and inert gas is inlet into the discharge container 8 via the pipeline 86 past valve 87.

The three-way valve 14 is now set in such manner that, via the pipeline 18 and the open valve 19, the washing liquid contained in the discharge container 8 can empty into the container 20, and the outlet liquid is replaced by inert gas via the valve 87.

The starting state is now re-established. The inert liquids 21 and 25 are in the meantime conveyed back into the feed container 32 and 33 by means of the pumps 30 and 31 from the containers 20 and 24. The inert liquid 25 used for washing purposes is cleansed of enriched electrolyte by means of the vaporizer 35. The galvanizing drum 44 is returned to the position illustrated in FIG. 1 in readiness for the next galvanizing process and the anodes 70 are returned to the solid-line position shown in FIG. 1.

Figure 2:
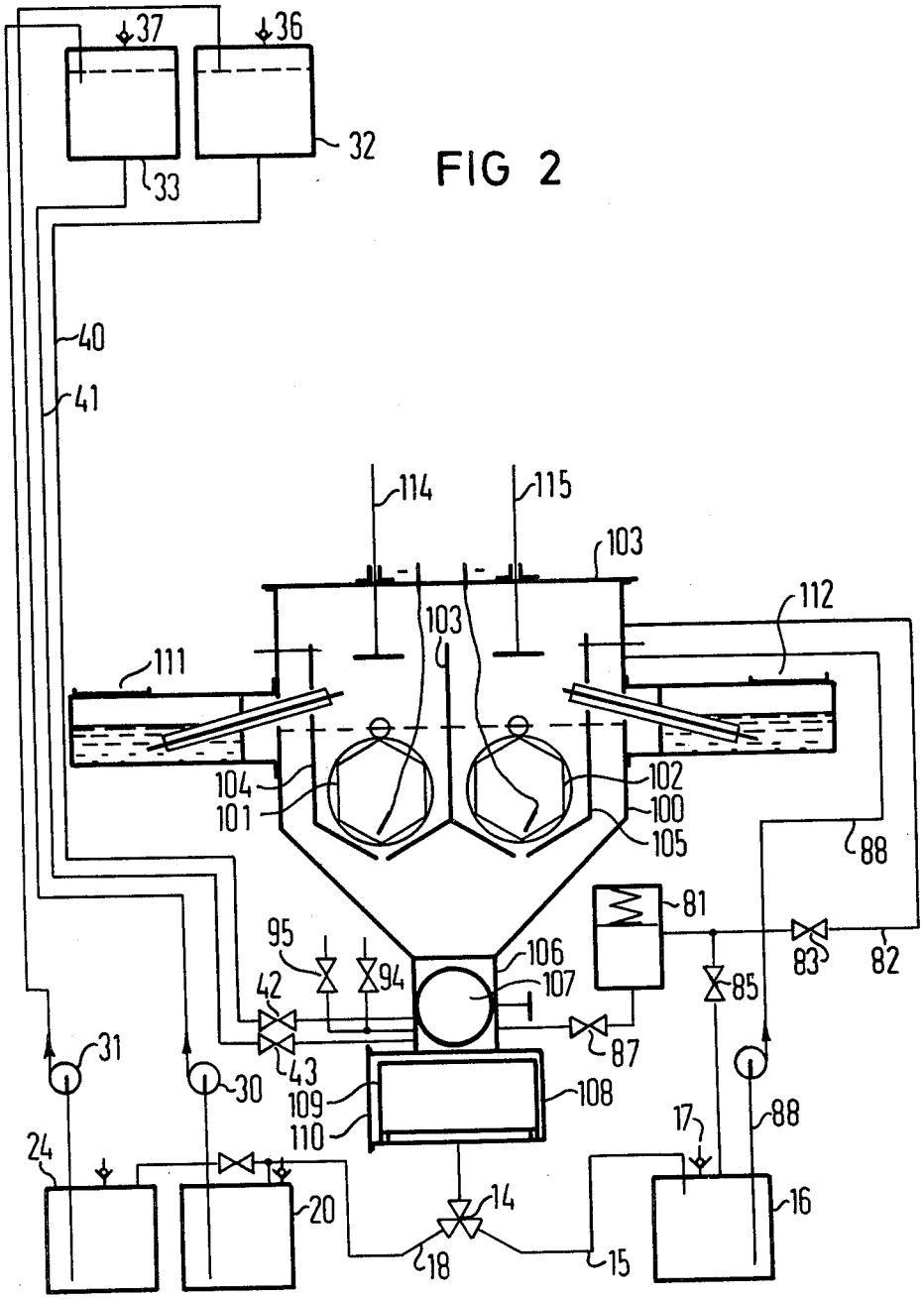

FIG. 2 illustrates an embodiment in which two galvanizing drums 101 and 102 are accommodated in a galvanizing tank 100. Whereas a central anode 103 is fixed in position, the two outer anodes 104 and 105 can be externally adjusted so that the bulk goods which are to be galvanized can be discharged into a common discharge container 108 via a common connecting component 106 which contains a ball valve 107. The discharge container 108 contains a filling basket 109 for the withdrawal of the bulk goods following the removal of a cover 110. A separate loading device 111 and 112 designed in accordance with the exemplary embodiment shown in FIG. 1 is provided for each of the galvanizing drums 101 and 102. Furthermore, a cover 113 contains two lifting mechanisms 114 and 115 for the opening of the galvanizing drums 101 and 102, respectively.

The control of the device illustrated in FIG. 2 is similar to that of the device shown in FIG. 1. In the device shown in FIG. 2, the two galvanizing drums 101 and 102 can be loaded simultaneously or alternately, although the electrolyte from the electrolyte feed container 16 must be maintained via level monitors in the galvanizing tank 100. For this reason, idenitically functioning parts in FIG. 2 have been provided with the same references as in FIG. 1.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth in the hereto appended claims.

We claim as our invention:

1. Apparatus for the galvanic deposition of aluminum onto work pieces from an aprotic, organo-aluminum electrolyte which is free of oxygen and water, comprising:

a heatable, gas-tight galvanizing tank;

a rotatable galvanizing drum mounted inside said galvanizing tank, including mounting means therefore;

means for supplying said galvanizing tank with an inert gas;

an electrolyte feed container and associated conduit means for supplying electrolyte to said galvanizing tank;

a pair of further containers each for the storage of inert fluid;

first airlock means associated with said galvanizing tank;

transport means for conveying said work pieces into the interior of said galvanizing tank via said first airlock means;

a discharge container;

means for supplying said discharge container with inert fluid;

said discharge container being arranged gravitationally below galvanizing tank; and second airlock means interconnecting said discharge container to said galvanizing drum and adapted for passage therethrough of said work pieces after galvanization.

2. The apparatus of claim 1 wherein said second airlock means contains a ball valve.

3. The apparatus of claim 1 wherein said transport means includes channel defining means which leads into the interior of said galvanizing tank, the channel thus defined rising obliquely upwards from and terminating outside said galvanizing tank, such terminating being in a container which is charged with inert liquid said container being a component of said first airlock means.

4. The apparatus of claim 3 wherein said channel means is sealed relative to said airlock container by a diaphragm means.

5. The apparatus of claim 3 wherein said transport device includes at least one adapted for said work pieces conveyor belt, one part of which is submergable in an invert fluid in said airlock container.

6. The apparatus of claim 3 wherein said airlock is attached in a gas-tight manner to said galvanizing tank.

7. The apparatus of claim 1 wherein said discharge container has a volume about equal to that of said galvanizing drum.

8. The apparatus of claim 7 wherein said discharge container contains a perforated filling basket which includes means for a gas-tight withdrawing of such through a gas-tight hatch means in said discharge container.

9. The apparatus of claim 8, wherein said filling basket possesses an oblique base.

10. The apparatus of claim 1, wherein a part of the galvanizing drum is submergable into electrolyte in said tank and is surrounded by two anodes which are adjustable relative to one another in such a manner that they form therebetween an opening for said work pieces to pass therethrough when such are to removed from said tank.

11. The apparatus of claim 1, wherein one of said pair of further containers is arranged above said galvanizing tank and the other thereof is arranged below said galvanizing tank, and said discharge container is connected to additional for inert liquids for flooding and washing said discharge container and optionally said galvanizing tank.

12. The apparatus of claim 1 wherein said inert gas supplying means is connected via conduit means and valve means to respectively, said galvanizing tank, said discharge container, and said electrolyte feed container, said conduit means and said said valve means forming sealable inert gas cycle system.

13. The apparatus of claim 1 wherein said galvanizing drum is openable and closable by a locking device which includes operating means therefore that extends through said galvanizing tank.

14. The apparatus of claim 13 wherein said locking device includes rotationally and axially displaceable lifting mechanism.

15. Apparatus for the galvanic deposition of aluminum onto work pieces from an aprotic organo-aluminum electrolyte free from oxygen and water comprising:

(A) a fluid-tight galvanizing tank;

(B) a galvanizing drum rotatably mounted within said tank, including mounting means therefore, said galvanizing drum having hatch means provided in a wall portion thereof;

(C) transport means for conveying such work pieces to said tank;

(D) airlock means associated with said tank for entrance of such work pieces into said tank from said transport means;

(E) operating means for opening and closing said hatch means from a location exterior of said tank;

(F) a discharge container located gravitationally below said tank including an interconnecting duct means and valve means for closing said duct means;

(G) said hatch means being alignable with said airlock means for receipt into said drum of such work pieces charged through said airlock means from said transport means and said hatch means further being alignable with said interconnecting duct means for receipt into said interconnecting duct means of such work pieces from said galvanizing drum after aluminization thereof;

(H) a powerhead for rotatably driving said galvanizing drum exteriorly located relative to said tank;

(I) means for supplying to and taking from, said tank inert fluid to remove air and moisture therefrom and to keep such substances out of said tank;

(J) reservoir means for such an electrolyte and including conveyance means for charging such electrolyte to and for removing such electrolyte from said tank and said drum therein; and (K) anode and cathode means for passing an electric current through such electrolyte in said drum for electrolytically depositing aluminum from said electrolyte on such work pieces which said drum is rotating.

16. A process for the galvanic deposition of aluminum onto pieces from an aprotic organo-aluminum electrolyte free from oxygen and water comprising the steps of sequentially:

(A) charging such work pieces into a rotatably mounted drum positioned in a fluid tight treatment zone, said drum having a hatch through which such work pieces are so charged;

(B) closing said hatch from a location which is exterior relative to said zone;

(C) flushing said zone and its contents with inert fluid to remove oxygen and water therefrom;

(D) charging such electrolyte to said zone in an amount sufficient to immerse a functional portion of said drum;

(E) rotating said drum and concurrently passing an electric current through said electrolyte to electrolytically deposit aluminum onto said work pieces;

(F) removing such electrolyte from said zone;

(G) opening said hatch from said location; and (H) removing such aluminized work pieces from said drum through said treatment zone.

* * * * *